United States Patent [19]

Silva

[11] 4,333,095

[45] Jun. 1, 1982

[54] BRUSH WEAR INDICATOR

[75] Inventor: Edmund J. Silva, North Royalton, Ohio

[73] Assignee: Reliance Electric Company, Cleveland, Ohio

[21] Appl. No.: 122,297

[22] Filed: Feb. 19, 1980

[51] Int. Cl.[3] ..... G08B 21/00

[52] U.S. Cl. ..... 340/679; 200/61.41; 310/245; 340/648

[58] Field of Search ..... 340/679, 648; 200/61.4, 200/61.41; 310/242, 245, 247, 251, 252, 253

[56] References Cited

U.S. PATENT DOCUMENTS

| | | | |
|---|---|---|---|
| 2,636,090 | 4/1953 | Branschotsky | 340/679 X |
| 2,691,114 | 10/1954 | Lykins | 200/61.4 X |
| 2,813,208 | 11/1957 | Ritter | 310/247 |
| 3,223,795 | 12/1965 | Yerman | 200/61.4 |
| 3,523,288 | 8/1970 | Thompson | 310/245 X |
| 4,024,525 | 5/1977 | Baumgartiner et al. | 200/61.41 X |
| 4,121,207 | 10/1978 | Jones | 200/61.4 X |

FOREIGN PATENT DOCUMENTS

| | | | |
|---|---|---|---|
| 1262486 | 2/1972 | United Kingdom | 340/648 |

*Primary Examiner*—John W. Caldwell, Sr.
*Assistant Examiner*—Joseph E. Nowicki
*Attorney, Agent, or Firm*—Pearne, Gordon, Sessions, McCoy & Granger

[57] ABSTRACT

An indicator is provided in a dynamoelectric machine such as a DC electric motor wherein brushes are provided in brush holders to cooperate with a rotatable electrical conductor in the machine, for example, slip rings or a commutator. The indicator gives an indication when a brush has worn to a point where it should be replaced, and then an alarm sounds or a light is illuminated. The brush wear indicator includes an indicator contact which is electrically connected to the indicator means and it is insulated from but mounted to move in accordance with the brush wear movement. The contact is provided on the end of an electrical conductor which is embedded in the rear axial end of the brush so that the indicator contact will become exposed and the insulation covering it will be worn away upon sufficient brush wear. This completes an electrical circuit between the indicator contact and the commutator to thus provide an indication at the indicator means.

16 Claims, 5 Drawing Figures

BRUSH WEAR INDICATOR

BACKGROUND OF THE INVENTION

Brush wear indicators for dynamoelectric machines, primarily motors with commutators, have previously been suggested. U.S. Pat. No. 4,024,525 shows a construction wherein an axial groove is formed in the edge of the brush and a fixed insulated contact is disposed in this groove which normally touches nothing and an indicator lamp is off. The lamp is illuminated when the brush wears, so that the insulated contact touches the outer end of the groove.

U.S. Pat. No. 2,813,208 discloses a cartridge-type brush holder wherein a brush has a rear central axial aperture and a spring-pressed insulated plunger is urged toward the commutator. When the brush wears, the insulated plunger breaks through the working face of the brush to engage the commutator and push the brush rearwardly away from the commutator to stop the motor.

U.S. Pat. No. 3,523,288 discloses a structure wherein a continuous electrical circuit is normally made through a lamp to energize it while the brush length is satisfactory. This circuit is made through a spring contact arm on the side of the brush holder and through a pin to the side of the brush. When the brush wears sufficiently, the pin drops into an aperture in the side of the brush and the lamp is then de-energized.

U.S. Pat. No. 4,172,988 discloses an extra contact arm electrically and physically connected to the rear axial end of the brush. Upon sufficient brush wear, this moving contact arm engages a fixed contact to energize an indicator.

U.S. Pat. No. 2,691,114 illustrates an extra cantilever contact arm which is insulated from but moves with a brush spring arm which urges the brush toward the commutator. Upon sufficient brush wear, the extra cantilever contact arm engages the brush holder to illuminate an indicator lamp.

U.S. Pat. No. 4,121,207 discloses a roller actuator on a fixed miniswitch and the roller will roll over the outer axial end of the brush upon sufficient wear thereof to close the switch and illuminate an indicator lamp.

The first four of the above-mentioned patents have the deficiency that if the indicator lamp is ignored, the brush wear indicator will hold the brush away from the commutator and thus stop operation of the motor. This may be very disadvantageous where interruption of the motor rotation would be highly undesirable. Even the fifth-mentioned patent has this disadvantage because the force with which the extra cantilever arm engages the brush holder is effectively subtracted from the force with which the spring arm urges the brush toward the commutator, and upon sufficient further wear the brush will no longer be urged toward the commutator. The difficulty with the last-mentioned patent is the relatively high cost of the separate miniswitch plus the difficulties of mounting such a switch on parts of the motor which may be at a high voltage, for example, 700 volts.

SUMMARY OF THE INVENTION

The problem may be solved by a brush wear indicator for use in a dynamoelectric machine having a rotatable electrical conductor comprising in combination, a brush holder in the dynamoelectric machine and having an axis, a conductive brush movable axially in said brush holder and having a working face cooperable with and contactable with the rotatable electrical conductor, indicator means, and an indicator contact electrically connected to said indicator means and insulatedly mounted on said brush to move in accordance with brush wear movement and upon sufficient brush wear to engage the rotatable electrical conductor of the dynamoelectric machine to complete an electrical circuit between said indicator contact and the rotating electrical conductor and thus provide an indication at said indicator means.

Accordingly, an object of the invention is to provide a brush wear indicator which is low in cost yet reliable in operation and which will not interrupt the operation of the dynamoelectric machine on which installed.

Another object of the invention is to provide a brush wear indicator which is actuated upon an indicator contact coming electrically into engagement with the commutator.

A further object of the invention is to provide a brush wear indicator which may be electrically connected to an indicator lamp or which may be electrically isolated from a brush wear indicator.

Other objects and a fuller understanding of the invention may be had by referring to the following description and claims, taken in conjunction with the accompanying drawing.

DESCRIPTION OF THE PREFERRED EMBODIMENTS

Figure 1:
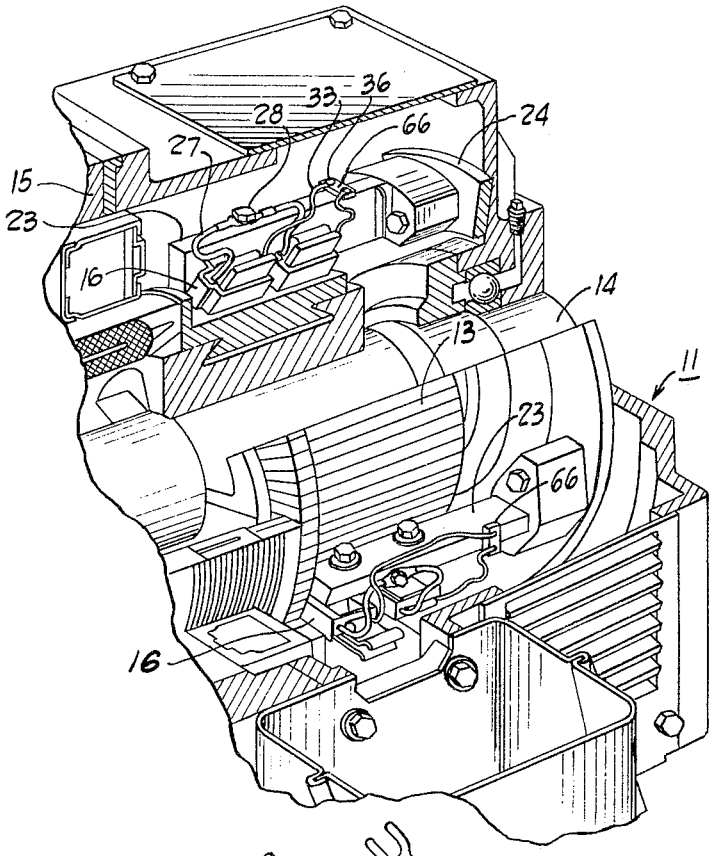
FIG. 1 is a perspective view of a dynamoelectric machine which may incorporate the present invention.

The drawing illustrates a brush wear indicator 10 which is for use in a dynamoelectric machine 11 which has one or more brushes 12 cooperable with a rotatable electrical conductor 13. The dynamoelectric machine 11 may be a generator or motor having a shaft 14 journaled in a frame 15, with the rotatable electrical conductor 13 mounted for rotation in accordance with the rotation of the shaft 14. This rotatable electrical conductor may be one or more slip rings or, as illustrated, may be a commutator. The brush 12 is one of a plurality of brushes cooperable with and contacting this commutator 13, and the brush 12 is one having an axis and mounted for axial movement in a brush holder 16. The axis 17 of the brush and the brush holder are coincident. The brush 12 has a working face 19 and a rear axial face 20. Some means are provided to urge the working face 19 of the brush 12 against the commutator 13, and this may be by a spring-urged arm or, as shown, by a coiled clock spring 21 which acts against an insulator pad 22 secured to the rear face 20 of the brush 12. Such an insulator pad 22 keeps the electrical current from flowing through the spring 21.

FIG. 1 illustrates the dynamoelectric machine 11 as having eight brush holders 16, and this is typical with larger four-pole machines. A pair of brush holders 16 are mounted on a brush holder arm 23, although this may be only a single brush holder or more than two brush holders per arm. Each arm is then mounted on a brush holder ring 24, and this is typically provided in larger machines so that the ring 24 may be slightly rotated relative to the frame 15 to achieve the best commutation, e.g., placing the brushes on a neutral magnetic axis for minimum arcing at the brushes. Insulation is provided somewhere between the brush holders and the frame.

Each brush is provided with a flexible power pigtail lead 27, which leads are connected to power terminals 28 on the brush holder arms 23, or some other convenient insulated position. The power pigtail lead is electrically connected to and fixed in the rear face 20 of each brush 12, which may be accomplished by tamping an electrically conductive cement into the aperture in the brush surrounding the pigtail lead 27 or, as shown, the pigtail lead 27 may be embedded in the carbonaceous material of the brush 12 at the time it is fabricated. Such lead 27 provides the usual supply of heavy current through the brush 12 to the commutator 13 to operate the dynamoelectric machine 11.

Figure 4:
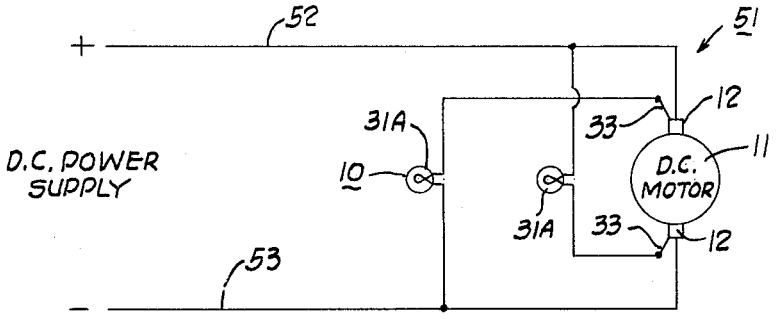
FIG. 4 is a schematic diagram of a brush wear indicator circuit.
Figure 5:
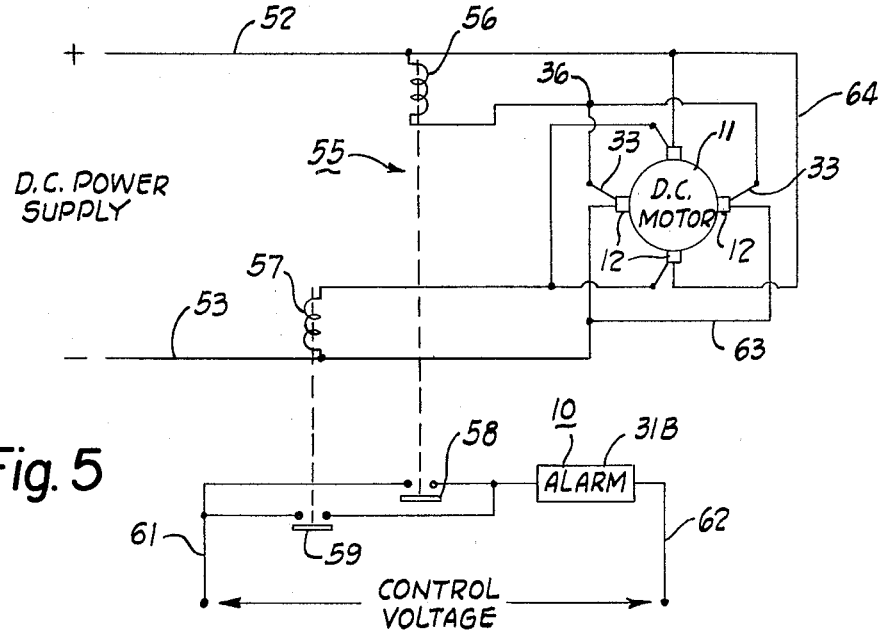
FIG. 5 is a schematic diagram of a modified brush wear indicator circuit.

The brush wear indicator 10 includes indicator means 31, such as the lamp 31A of FIG. 4 or the indicator alarm 31B of FIG. 5. The brush wear indicator 10 also includes an indicator contact 32 which is insulatedly mounted on the brush 12 and connected to the indicator means 31 by an elongated electrical conductor 33. A forward portion of this elongated electrical conductor is fixed relative to the brush 12 to move with brush wear movement just as the indicator contact 32 moves with brush wear movement. To this end the indicator contact 32 is embedded within the brush 12 so as to be within the confines of the brush and also within the confines of the brush holder 16, or at least within the confines of the longitudinal extension of the cross sectional area of the brush holder perpendicular to the axis 17.

The indicator contact 32 may be merely the end of the electrical conductor 33 which is closest to the working face 19 of the brush 12, or it may be an end of a separate electrical conductor 34 which preferably is made from a soft electrically conductive material such as soft aluminum, so that upon brush wear and engagement of this indicator contact with the commutator 13 the commutator will not be damaged. Copper bar commutators quickly develop a copper oxide surface on which the brushes ride, and it is preferable for good motor operation that this copper oxide film be maintained unbroken. Where the separate electrical conductor 34 is provided, it may be electrically connected to the electrical conductor 33 by a tamped electrically conducting cement 35, similar to the manner in which the power pigtail lead 27 may be connected to the brush 12. The electrical conductor 33 is provided with a terminal 36 and also provided with an insulation jacket 37. The electrical conductor 34 is electrically insulated from the brush 12 by means of a cup-shaped insulating sleeve 40 which preferably has a closed inner end 41 covering the indicator contact 32. In a preferred embodiment, this insulating sleeve is made from a heat shrinkable polyolefin. This assembly of insulated conductors 33 and 34 may then be inserted in a predrilled hole in the rear end of the brush 12 and held in place by cement 42 at the rear of the brush, or by cement 43 surrounding the insulating sleeve 40.

Figure 2:
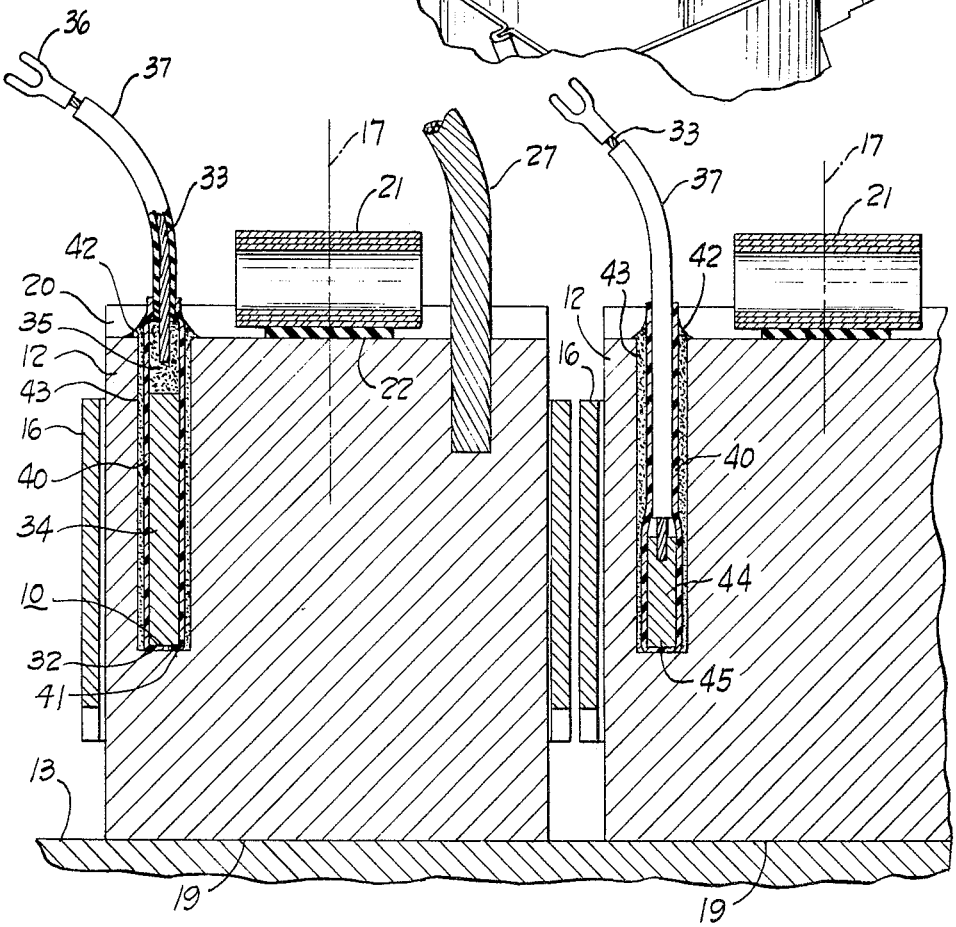
FIG. 2 is a longitudinal sectional view through brush holders and brushes having part of the brush wear indicator.

An alternative construction is shown at the right side of FIG. 2 wherein a second brush holder 16 as shown as an example of those instances wherein a dynamoelectric machine 11 has a large current capacity and requires more than one brush 12. This alternative construction still employs the insulated conductor 33, but in this case it is longer and extends farther into the brush 12 and the conductor 33 is embedded into a miniature cylindrical brush 44 of carbonaceous material and the inner end 45 of this brush constitutes the indicator contact. The miniature brush 44, indicator contact 45, and inner end of the conductor 33 are covered again with the insulating sleeve 40 and held in place in a predrilled hole in the brush 12 by the cement 42 or 43. The material of the insulating sleeve 40 is sufficiently soft that the end covering the indicator contact 32 or 45 will wear away upon sufficient brush wear movement so as not to damage the surface of the commutator 13.

Figure 3:
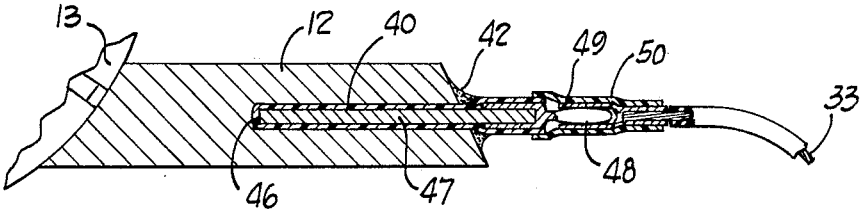
FIG. 3 is a longitudinal, sectional view through a brush having a modified brush wear indicator.

FIG. 3 illustrates a modified indicator contact 46 in a brush 12 and the longitudinal sectional view of FIG. 3 is taken at right angles to the sectional view of FIG. 2 to illustrate the curvature of the commutator or other rotatable electrical conductor 13. In this embodiment, the indicator contact 46 is on the end of an elongated rod 47 of carbonaceous material, which may be similar to the graphitic lead found in a mechanical pencil or drafting pencil. In order to make connection to the flexible conductor 33, a male banana plug 48 is mechanically and electrically crimped on the outer end of the rod 47. The connector portion of this male banana plug and the elongated rod 47, as well as the indicator contact 46, are again covered by an elongated cup-shaped, insulating sleeve 40. Again, this may be of a heat shrink polyolefin which rigidifies and strengthens the carbonaceous rod 47. This unit as thus far described extends out the rear of the brush so that a female banana plug 49 may engage the male banana plug 48. This female banana plug 49 is electrically and mechanically connected to the flexible electrical conductor 33. Preferably, a heat-shrinkable tube 50 covers the female banana plug 49 and even telescopes over the outer end of the sleeve 40 to completely insulate this indicator conductor 33. The heat-shrinkable tube or sleeve 40 may fit closely within a predrilled hole in the rear end of the brush 12, and be held in place by cement 42, as in FIG. 2. This unit has the advantage of requiring only a small diameter hole for the indicator contact 46.

FIGS. 4 and 5 illustrate the indicator circuits which may be used with the indicator contacts 32, 45 or 46. FIG. 4 illustrates a circuit 51 wherein the indicator means 31A are warning lamps. The dynamoelectric machine 11 is shown as a two-pole DC motor having brushes 12 connected across power buses 52 and 53, and these would be connected to the main or power pigtail leads 27 on the brushes 12. The indicator contacts 32, 45 or 46 from each of the two brushes would be connected through the indicator lamps 31A to the opposite power bus so that the full voltage across the commutator is applied to each warning light 31A. Such warning light would remain unenergized until the brush 12 wore down a predetermined amount so as to wear through the end cap of the insulating sleeve 40 and have the commutator 13 engage the indicator contact 32, 45 or 46. At such time, the voltage across the buses 52 and 53 would be applied to the respective warning light to indicate which one of the two brushes had worn to an extent at which replacement would be required. The motor remains operative, however, as distinct from several of the prior art systems, wherein the brush wear indicator could prevent the working face 19 of the brush 12 from engaging the commutator, which would stop operation of the motor. The motor 11 might be one wherein it is critical that motor operation be maintained, even though the brush has worn to a point at which replacement should be effected. Such warning lamp might be continuously illuminated at such time, or might be intermittently illuminated if the insulator contact 32, 45 or 46 is narrow relative to the insulation spacing between commutator bars. In such case, such intermittent flashing would help invite attention to recommended brush replacement.

FIG. 5 illustrates a circuit 55 wherein the indicator 31B is an alarm which may be aural or visual, and is electrically isolated from the dynamoelectric machine 11. Such machine 11 has been illustrated as a four-pole machine similar to that shown in FIG. 1. This electrical isolation is achieved by relay coils 56 and 57 which control contacts 58 and 59, respectively. Such contacts may be normally closed contacts, but are shown as normally open contacts connected in parallel, and this parallel arrangement connected in series through the alarm 31B between control voltage buses 61 and 62. The relay coil 56 is connected between the power bus 51 and the indicator contact 32, 45 or 46 on each of two diametrically opposite brushes 12 in the motor 11. As per usual custom in a four-pole machine, these two brushes are shown connected in parallel by a jumper 63. Likewise, a jumper 64 connects in parallel the other two brushes 12, which are diametrically opposite and which two brushes are midway between the first-mentioned set of brushes. It will readily be appreciated that four relays 56 or 57 may be provided, one for each brush, but in FIG. 5, it is shown that one relay is controlled by either of two brushes. As shown in FIG. 1, the several terminals 36 from the indicator contacts in all of the brushes in one set riding on one commutator bar are connected to a terminal block 66 which is mounted at some convenient location, for example, the brush holder arm, but insulated therefrom.

In the circuits of FIGS. 4 and 5, it will be apparent that the indicator means 31A or 31B need not be at the motor; in fact, the indicator of the present invention permits remote indication of the condition of the brush wear. This is especially important where the motor may be in some relatively inaccessible location and management is concerned that proper maintenance of the motor may be overlooked because it is too difficult to properly observe brush conditions at such relatively inaccessible motor.

In FIGS. 2 and 3, it has been illustrated that the miniature brush 44 or elongated rod 44 is substantially parallel to the brush axis 17. This is not mandatory; the essential feature is that the indicator contact 32, 45 or 46 be connected in some manner to the indicator 31, and it is convenient to have the indicator conductor 33 exit from the rear end of the brush 12. This minimizes any interference with the spring 21 or brush holder 16.

In FIGS. 4 and 5, it will be noted that a particular indicator contact 32 or 46 is connected through the indicator 31A or 31B to the power bus of the opposite potential. This is a convenient means for obtaining a potential difference across the indicator lamp 31A or across the relay coils 56 or 57, and it is merely a requirement that such indicator be connected from the respective indicator contact through the indicator to a terminal of an electrical potential different from that of the indicator contact.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the parts and circuit and the combination and arrangement of parts and circuit elements may be resorted to without departing from the spirit and the scope of the invention as hereinafter claimed.

What is claimed is:

1. A brush wear indicator for use in a dynamoelectric machine having a rotatable electrical conductor comprising in combination, a brush holder in the dynamoelectric machine and having an axis, a conductive brush movable axially in said brush holder and having a working face cooperable with and contactable with the rotatable electrical conductor, indicator means, an indicator contact having first and second ends and insulatedly mounted on said brush to move in accordance with brush wear movement, separate conductive means insulatedly mounted on said brush and having first and second ends with said second end connected to said indicator means and said first end connected to said second end of said indicator contact, and said working face of said brush being disposed closer to said first end than to said second end of said indicator contact, whereby upon sufficient brush wear said indicator contact first end engages the rotatable electrical conductor of the dynamoelectric machine to complete an electrical circuit between said indicator contact first end and the rotatable electrical conductor and thus provide an indication at said indicator means.

2. A brush wear indicator as set forth in claim 1, wherein said indicator contact first end is of material softer than the surface of the rotatable electrical conductor.

3. A brush wear indicator as set forth in claim 2, wherein said indicator contact first end is an end of a small diameter brush of carbonaceous material.

4. A brush wear indicator as set forth in claim 3, wherein said insulated mounting includes a heat-shrunk insulation tube covering the small diameter brush and working first end thereof as well as said separate conductive means in said first-mentioned brush.

5. A brush wear indicator as set forth in claim 1, wherein said indicator contact first end is on one end of an elongated conductor and a disconnectable push-on electrical plug is on the other end of said elongated conductor.

6. A brush wear indicator as set forth in claim 5, wherein said insulated mounting of said indicator contact includes an insulating sleeve surrounding said elongated conductor and with said sleeve being disposed in an aperture in the rear face of the brush with said electrical plug exposed on the rear face of the brush.

7. A wear-indicator brush structure for a dynamoelectric machine having a rotatable electrical current conductor with a circumferential surface disposed to contact an end of the brush longitudinally movably mounted in a brush holder having a given cross-sectional area, said brush structure comprising:

an electrically conductive brush element having a cross-sectional area corresponding to and smaller than the given cross-sectional area of the brush holder in which said brush element is adapted to be mounted and adapted to be longitudinally movable therein;

a first and a second longitudinal end on said brush element with said first end adapted to contact the rotatable electrical current conductor;

an indicator contact having first and second portions fixed to said brush element with said first portion at a given longitudinal position intermediate the longitudinal ends thereof as manufactured and adapted to engage and make electrical contact with the rotatable electrical current conductor upon the first end of the brush element wearing to said given longitudinal position of said indicator contact;

an electrical conductor separate from said indicator contact and electrically connected to said indicator contact second portion at a point more remote from said brush element first end than said indicator contact first portion; and means insulating said indicator contact and said separate electrical conductor from said brush element.

8. A brush structure as set forth in claim 7, wherein said first portion of said indicator contact is an axial end facing said first longitudinal end of said brush element, and solid insulation covering said axial end.

9. A brush structure as set forth in claim 7 wherein said separate electrical conductor is partially embedded within said brush element and extends outwardly from said second longitudinal end thereof.

10. A brush structure as set forth in claim 7, wherein said indicator contact is of material softer than the hardness of the surface of the rotatable electrical current conductor adapted to be engaged by said brush element.

11. A brush structure for a dynamoelectric machine having a rotatable electrical current conductor with a circumferential surface disposed to contact an end of the brush mounted in a brush holder having a given cross-sectional area, said brush structure comprising:

an electrically conductive brush element having a cross-sectional area corresponding to and smaller than the given cross-sectional area of the brush holder in which said brush element is adapted to be mounted;

a first and a second longitudinal end on said brush element with said first end adapted to contact the rotatable electrical current conductor;

an indicator contact fixed to said brush element at a given longitudinal position intermediate the longitudinal ends thereof as manufactured;

conductor means separate from said indicator contact, electrically connected to said indicator contact and providing external electrical connection to said indicator contact;

means to insulate said indicator contact and said separate conductor means from the electrically conductive brush element and adapted to insulate said indicator contact and said conductor means from a brush holder in which said brush element is adapted to be mounted;

said indicator contact, separate conductor means, and insulation means being substantialy within the cross-sectional area of said brush element and adapated to be within the given cross-sectional area of a brush holder in which said brush element is adapted to be mounted;

and said indicator contact adapted to engage and make electrical contact with the rotatable electrical current conductor upon the first end of the brush element wearing to said given longitudinal position of said indicator contact.

12. A brush structure as set forth in claim 11, wherein said insulation means includes an insulator sleeve between said conductor means and said brush element and between said indicator contact and said brush element.

13. A brush structure as set forth in claim 12, wherein said insulator sleeve is a heat-shrunk sleeve covering the indicator contact and said conductor means.

14. A brush structure as set forth in claim 12, including an aperture longitudinally disposed in said brush element;

said indicator contact and at least part of said separate conductor means and insulator sleeve being disposed in said aperture;

and cement securing said indicator contact, conductor means, and insulator sleeve in said aperture.

15. A brush structure as set forth in claim 11, wherein said conductor means is at least partially embedded in said brush element.

16. A brush structure as set forth in claim 11, including a force-applying area established centrally on said second longitudinal end of said brush element for application of a force urging said brush element longitudinally toward the rotatable electrical current conductor, and said separate conductor means being disposed to one side of said force-applying area.

* * * * *